United States Patent [19]

Lieber

[11] 4,113,049

[45] Sep. 12, 1978

[54] NOISE REDUCTION DEVICE FOR IMPACT TOOLS

[76] Inventor: Raymond S. Lieber, 1105 Alumni Ave., Las Cruces, N. Mex. 88003

[21] Appl. No.: 676,878

[22] Filed: Apr. 14, 1976

[51] Int. Cl.[2] ..... G10K 11/04; E04B 1/99

[52] U.S. Cl. ..... 181/230; 173/DIG. 2; 181/211

[58] Field of Search ..... 181/36 A, 36 D, 33 K, 181/230, 211, 200, 205; 227/51; 173/DIG. 2, 128

[56] References Cited

U.S. PATENT DOCUMENTS

| | | | |
|---|---|---|---|
| 2,122,517 | 7/1938 | Curtis | 181/36 A |
| 2,136,315 | 11/1938 | Pettit | 181/36 A |
| 2,789,653 | 4/1957 | Fannen | 181/36 A |
| 3,202,239 | 8/1965 | Clarke | 181/36 A |
| 3,225,861 | 12/1965 | Reynolds | 181/36 A |
| 3,757,891 | 9/1973 | Krieger | 181/36 A |

FOREIGN PATENT DOCUMENTS

| | | | |
|---|---|---|---|
| 602,986 | 3/1960 | Italy | 181/36 A |

*Primary Examiner*—Stephen J. Tomsky
*Attorney, Agent, or Firm*—John E. Benoit

[57] ABSTRACT

A noise reduction device for use with an impact tool which comprises a deformable block having a flat face and an opening therein for accepting the set of the tool, and a cylindrical housing extending from the block and sealed about the tool, with an open conduit extending from said housing.

4 Claims, 5 Drawing Figures

NOISE REDUCTION DEVICE FOR IMPACT TOOLS

This invention relates to noise reduction devices for rivet guns and similar impact tools. Its main object is to attenuate the sound generated during such impact operations. How it attains this object and other objects will become clear from the following description taken together with the drawings wherein like parts are given like numbers.

Traditionally the problem of the noise pollution caused by impact tools such as pneumatic rivet guns has been dealt with in one of four different ways: first, by utilizing different tools which produce lower noise levels; i.e. compression rivet guns and pop rivet guns; secondly, by requiring the workers to utilize personal ear protection; thirdly, by limiting the amount of time that the worker is exposed to the noise; and, finally, by utilizing mufflers and other similar acoustical shields on the tool. The present invention improves upon such acoustical shields.

There are many cases in which these alternatives do not provide an adequate solution to the noise pollution problem. Alternative methods such as pop rivets and compression rivet guns are expensive and can not be used in all cases. Pop rivets do not have the strength of buck rivets. Personnel ear protection, according to the William-Steiger Occupational Health and Safety Act, is a last resort after attempting to solve the problem through engineering type solutions. In addition, personnel ear protection often becomes a source of conflict between employers and employees. Limiting the exposure time tends to be a poor management technique since workers are getting paid for being idle forcing production costs up. The use of mufflers and acoustical shields as presently configured does not affect the transmission of the tool noise through the rivet or the noise generated at the rivet; in addition, they do not attenuate the sound transmitted through to the workpiece and back to the air. This phenomena is referred to as the sounding board effect because of the similarity between the transmission of the sound through the rivet, the workpiece, and into the air as compared to the transmission of the sound produced by a piano as it goes through the sounding board and into the air. The result of the sounding board affect is that the noise generated by the riveting operation, or similar impact tool operations, may be amplified by the workpiece. This invention deals with this important source of noise pollution.

The drawings and description hereinafter given describe the invention in general terms, as well as showing the specific application of the invention to a pneumatic rivet gun. It should be remembered that the illustrations are given for the purpose of providing an example of an application only, and not to provide a limitation to the application, embodiment or scope of this invention since it is applicable to other impact tools with equal facility and usefulness. Furthermore, the phraseology used herein is for the purpose of description and not limitation. With the preconditions as stated above understood, the invention is herein illustrated with reference to the drawings in which the corresponding numerals refer to the same parts.

Figure 1:
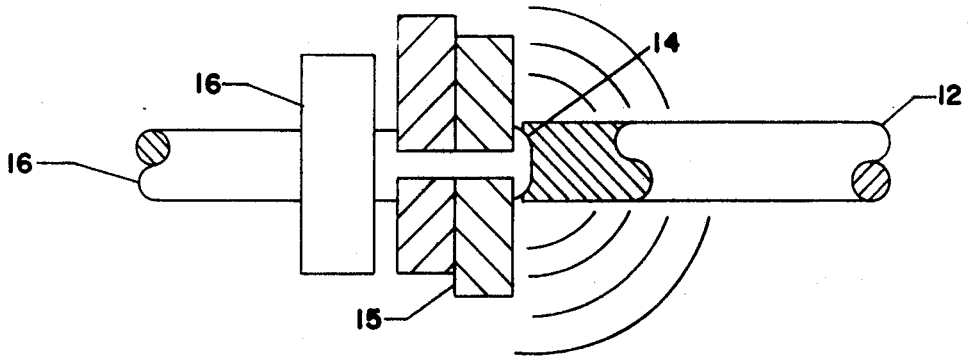
FIG. 1 shows a detail view of a rivet set striking a rivet.

FIG. 1 shows a detail view of a rivet set 12 striking a buck rivet 14. The bucking bar 16 has a tendency to be acoustically damped since it is being held by a worker. However the workpiece 15 is not damped, and neither is the rivet 14. The rivet set 12, aside from any noise which it might generate by striking the rivet 14, transmits the noise generated by the pneumatic rivet gun. As can be seen from the drawing, a direct path leads from the rivet set 12 to the rivet 14 to the workpiece 15. This situation provides the scene for the aforementioned sounding board affect. The purpose of this invention is to supress the sound generated by the tool, the sound generated on impact, and the sounding board affect.

Figure 2:
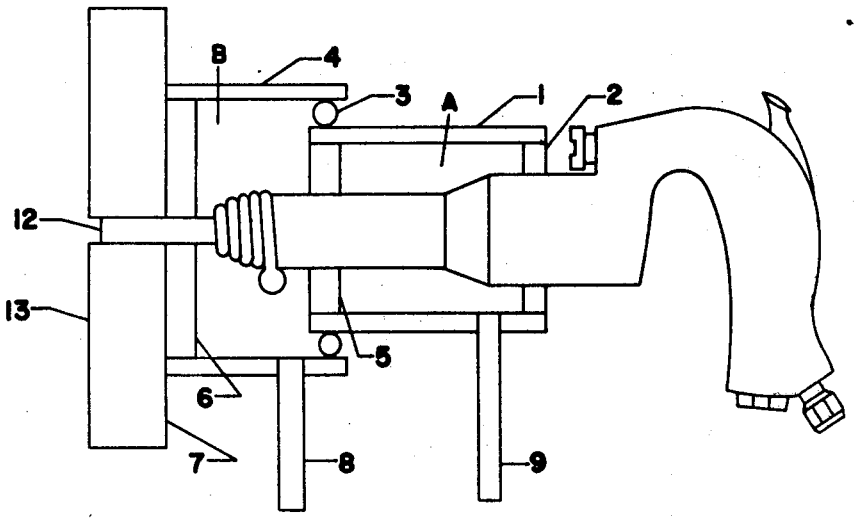
FIG. 2 shows a sectional view of the invention on a pneumatic rivet gun.

FIG. 2 shows the invention on a pneumatic rivet gun. The invention has three basic attributes. First, it suppresses the noise created by the tool. This attenuation is provided in FIG. 2 by two compartments A and B. The first compartment A is formed by a metal cylinder 1, two rubber rings 2 and 5, and a rubber hose 9. The rubber rings 2 and 5 may be secured between cylinder 1 and the gun housing by means of an adhesive or the like. Compartment B is formed by an O-ring 3, two rubber rings 5 and 6, a metal cylinder 4, and a rubber hose 8. Rubber rings 2 and 5 are secured to the outer housing 43 of the tool by means of adhesive, or the like. Both compartments are filled with sound absorbing materials such as fiber glass. Other suitable materials may be substituted for rubber and metal. The fiber glass, or similar material, attenuates the sound of the air rushing through the tool and out into the atmosphere. The rubber hose acts as a secondary muffler and directs the sound away from the worker's ears. In addition, the compartments act as a barrier, blocking the impact noise produced internally by the tool. The second attribute of this invention is that it does not adversely affect the motion of the tool while it is attenuating the sound produced by the tool. This property is provided by the configuration of the compartments; i.e., the metal cylinder 4 of compartment B rides on an O-ring 3 which rides on the outside of the metal cylinder 1 for the other compartment A. The third attribute of this invention is that it reduces the sounding board effect. This property is provided by securing a piece of rubber block 7, or similar material, to cylinder 4 by means of adhesive or the like. A on the rivet set 12 terminates so as to provide a gap which is long enough to allow the rubber to compress such that the rivet is completely sealed, and short enough to allow the rivet set to operate properly. The face 13 of block 7 is substantially flat so as to substantially reduce the sound created by the rivet set striking the rivet, and the sound transmitted from the rivet gun through the rivet set to the rivet, and further attenuates the sounding board effect by damping the vibrations in the workpiece.

Figure 3:
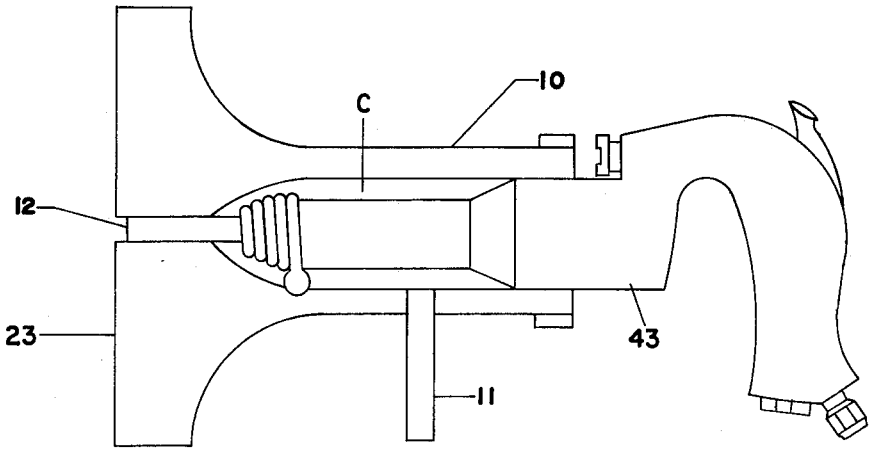
FIG. 3 shows a sectional view of a further embodiment of the invention on a pneumatic rivet gun.

These same three attributes are found in the alternate embodiment shown in FIG. 3, even though the invention in FIG. 3 is one piece. The noise reduction block 10 is made of resilient plastic, or similar material, such as rubber and has the ability to deform in a manner similar to the invention in FIG. 2. In the configuration of FIG. 3, the noise reduction device 10 is bonded to the tool set 12 and to the outer housing 43 of the tool. Therefore, in both FIG. 2 and FIG. 3, the blocks 7 and 10 must compress in order to form an effective acoustical seal. Because it has this ability to deform, it requires only one compartment filled with sound absorbing material and only one hose to provide the same sound absorbing properties as the invention in FIG. 2. The front 23 of the noise reduction device is configured in a manner similar to the invention as described in FIG. 2.

Figure 4:
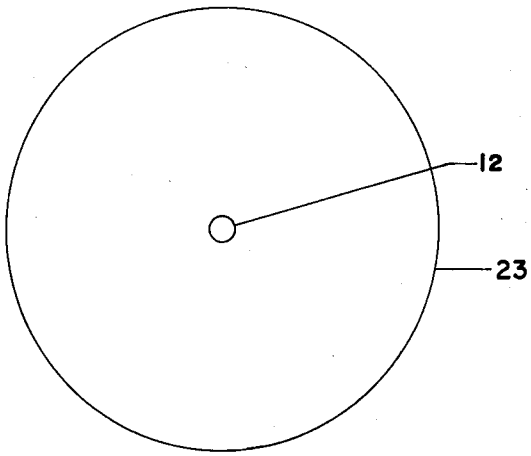
FIG. 4 shows a frontal view of the invention on a pneumatic rivet gun.

FIG. 4 shows a front view of the invention. The face 13 of noise reduction device 10 may be shaped to meet specific job requirements. For some applications, it may be necessary for the rivet set to fit into a hole large enough only for the rivet set as in FIG. 5. In this situation, the rivet set extends out from the face 33 of the noise reduction device the length of the hole less the length of the gap in FIGS. 2 and 3. In this and similar ways, this noise reduction device may be adapted by those skilled in the art to meet any production or maintenance and repair situation utilizing rivet guns and similar impact tools.

Figure 5:
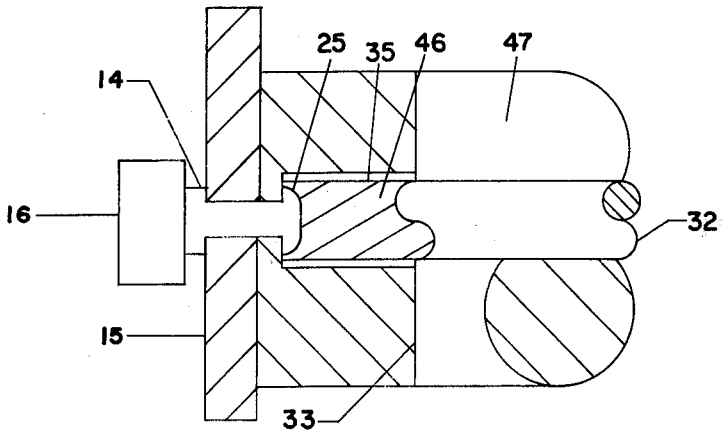
FIG. 5 shows a detail of the invention in a special application where the rivet set must fit into a hole large enough only for the rivet set.

FIG. 5 discloses a special application of the invention wherein the head 25 of rivet 14 is recessed within a hole using a bucking bar 16. In this case, the rivet set 32 extends beyond the face 33 of noise reduction device 47 a distance determined by the depth of the hole 46 and the height of the rivet head 25.

From the above description, it is obvious that this invention provides an effective means of limiting the noise produced by a pneumatic rivet gun and similar impact tools. It should be understood that the above arrangements of the invention were meant to be illustrative of the principals embodied in the invention; other similar arrangements could be devised by persons skilled in the art; these arrangements should embody the principals of the invention and meet the particular requirements of individual tools. Therefore reference should be made to the following claims rather than to the specific descriptions herein to indicate the scope of this invention.

I claim:

1. A noise reduction device for use with a reciprocating impact tool comprising
   - a rigid cylinder;
   - resilient walls at both ends of said cylinder secured between said cylinder and the outer housing of said tool so as to provide a first compartment about said housing;
   - a second rigid cylinder having a larger diameter than said first rigid cylinder;
   - means for sealing one end of said second cylinder about the outer circumference of said first cylinder;
   - a resilient block having a substantially flat face;
   - an opening in said block for accepting the set of said impact tool, said set being in contact with said resilient block;
   - means for sealing said resilient block within the other end of said second cylinder; and
   - a conduit extending outwardly from said first and second compartments.

2. The device of claim 1 further comprising sound absorbing material within said compartments.

3. A noise reduction device for use with an impact tool comprising
   - a deformable block having a substantially flat face;
   - an opening in said block for accepting the set of said tool said set being in contact with said deformable block
   - a cylinder wall extending from said block and sealed about the outer housing of said tool so as to form a at least one compartment; and
   - a conduit extending outwardly from said compartment.

4. The device of claim 3 further comprising sound absorbing material within said compartment.

* * * * *